US006300857B1

(12) United States Patent
Herwig

(10) Patent No.: US 6,300,857 B1
(45) Date of Patent: Oct. 9, 2001

(54) INSULATING TOROID CORES AND WINDINGS

(75) Inventor: Warren E. Herwig, Oshkosh, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/685,710

(22) Filed: Oct. 11, 2000

Related U.S. Application Data

(63) Continuation of application No. 08/989,997, filed on Dec. 12, 1997, now abandoned.

(51) Int. Cl.[7] ..... H01F 27/28; H01F 27/30

(52) U.S. Cl. ..... 336/229; 336/198; 336/206; 336/205

(58) Field of Search ..... 336/200, 205, 336/229, 212, 206, 198; 29/605, 606, 602.1; 324/127

(56) References Cited

U.S. PATENT DOCUMENTS

| | | | |
|---|---|---|---|
| 1,548,388 | | 8/1925 | Shackelton . |
| 1,784,833 | | 12/1930 | Hagemann . |
| 1,897,604 | | 2/1933 | Clemons . |
| 2,216,863 | | 10/1940 | Visman . |
| 2,290,680 | | 7/1942 | Franz . |
| 2,865,086 | | 12/1958 | Whipple . |
| 3,008,108 | | 11/1961 | Baker et al. . |
| 3,068,381 | | 12/1962 | Vazquez . |
| 4,763,072 | | 8/1988 | Katoh et al. . |
| 4,771,957 | * | 9/1988 | Schlake et al. ..... 242/437.1 |
| 5,488,344 | | 1/1996 | Bisbee et al. . |
| 5,717,373 | * | 2/1998 | Vachris ..... 336/206 |

* cited by examiner

*Primary Examiner*—Anh Mai
(74) *Attorney, Agent, or Firm*—George R. Corrigan

(57) ABSTRACT

A transformer and method of making a transformer is disclosed. The transformer has a magnetic core, a first winding and a second winding. The first and second windings are wound about the core, and an insulating jacket, which includes a plurality of protrusion, mounted about the core. One of the first and second windings is wound about the insulating jacket. The core is preferably a toroid core in one embodiment. Some of the anchors are on the inner diameter of the insulating jacket, and other on the outer diameter of the insulating jacket. The anchors are preferably spaced at equal circumferential positions. The windings are a progressive windings, with various sections, and each section has a number of layers. Each progressive section is anchored by at least two of the anchors. The first and second windings are wound directly on the core insulation, and the insulating jacket is mounted directly on the core. The windings are separated by protrusions having sufficient size to provide electrical clearance and reduce electrical creepage.

25 Claims, 4 Drawing Sheets

INSULATING TOROID CORES AND WINDINGS

This is a continuation of U.S. patent application Ser. No. 08/989,997, filed Dec. 12, 1997, now abandoned and entitled Insulated Toroid Cores And Windings.

FIELD OF THE INVENTION

The present invention relates generally to the art of winding transformers. More specifically, it relates to a method of winding and insulating toroid transformers.

BACKGROUND OF THE INVENTION

Toroid core transformers, and methods of constructing transformers having toroid cores, have been known for many years. A toroid transformer is made by placing windings around a core having a toroid shape. Such windings require the conductor to be wound through the center "hole" of the toroid core. One typical arrangement is to have the primary wound on one-half the toroid (from 12:00 to 6:00 eg.) and the secondary (or other windings) wound on the remaining half.

Another typical arrangement has the primary, secondary, and etc. windings wound in layers (for example the primary winding may be a first layer and a secondary winding may be a second layer, or vice versa). Thicknesses of insulation are provided between windings to provide a dielectric between the various windings. The insulation is often layers of film which are wound through the center "hole" of the toroid core. Alternative winding constructions may include coaxial or bifilar conductors.

One advantage of toroid construction, relative to other physical constructions, is a reduction of material volumes needed for the core for a given electrical capacity. This reduces the weight and cost of the transformer. However, the equipment required to wind long conductor lengths on a toroid core is costly and complex. Additionally, the winding of the conductor and insulating films through the center hole of the toroidal core is labor intensive, thus increasing the cost of making the winding.

One type of toroidal transformer winding is called progressive winding. A progressive winding is one in which the coil is wound such that portions of a total winding are wound in a number of pie-shaped segments around the toroid. Each pie-shaped segment is comprised of an odd number of layers, and the even numbered layers are pitched in a direction opposite the direction of the pitch of the odd numbered layers. After the desired odd number of layers have been completed, the subsequent pie shaped segments of the toroid are wound, again by layers. This is repeated until the winding is complete. Progressive winding reduces the maximum turn to turn voltage gradient or stress on the conductor insulation.

While progressive winding reduces voltage stress, it results in problems when wound according to the prior art. Specifically, when the second layer of a particular segment is being wound, the end turns of the second layer tend to force the end turns of the first layer outward. This results in the windings having undesirable spacing and difficulty placing the maximum desired number of turns on a toroid for a given size toroid.

The inability to precisely place windings (particularly the end turns) or stack layers results in the disadvantage that the density of the windings, or the number of turns per square inch of coil cross section, is less than the maximum possible.

If the turns aren't placed as densely as possible, then additional layers must be provided to accommodate the desired number of turns, and the initial hole in the center of the toroid core must have a greater diameter. This necessarily results in a greater length of the core magnetic path and a greater core volume and weight. The increase core volume and weight results in increased material costs. Also, the equipment to wind the toroid core must be able to pass through the "hole" of the toroid. Thus, it is helpful to have the turns placed as densely as possible to keep the center "hole" large enough for the winding equipment to pass therethrough.

There are numerous insulation configurations and winding techniques for toroid transformers in the prior art. Known insulation configurations include the use of molded jackets, molded insulation parts having features that place individual conductors in specific locations, and flexible film insulating the core. Two known winding techniques include programming winding equipment to locate conductors on molded insulation and flexible film insulation separating multi-coil windings by thicknesses of the film insulation.

However, each of these prior art techniques and/or apparatuses do not provide a way to specifically anchor or hold in place the pie-shaped segments of progressive windings. The lack of anchoring these progressive winding section results in the spreading of the section, particular when winding multiple layers in the section.

Accordingly, it is desirable to have a transformer and a method of winding a transformer that provides for progressive winding without spreading of the lower layers of windage. Such a method and apparatus should be relatively simple and low cost, with a reduced labor content. It is also desirable to provide a transformer and a method of winding a transformer that provides a greater density of windings per square inch of core cross section than the prior art methods. Such a method should also provide a toroidal transformer that has a relatively small center hole in the toroid and a shorter main length of the core magnetic path than prior art methods.

Electrical clearance and electrical creepage are two potential problems associated with transformers. Electrical clearance relates to the physical distance (through air) between windings. Insufficient electrical clearance, for a given voltage difference between windings, may result in electrical arcing between the windings. Electrical creepage refers to an electric "arc" that travels across surfaces between two windings. Industry standards exist for electrical clearance and creepage that require specified physical distances between windings for various voltage differences.

Accordingly, it is desirable to have a transformer, and method of making a transformer, that eliminates or reduces the use of film insulation between windings. Also, sufficient air clearance between windings should be provided. Preferably creepage distances across surfaces will be sufficient

SUMMARY OF THE PRESENT INVENTION

A transformer comprises a magnetic core, a first winding and a second winding according to one aspect of the invention. The first winding is wound about the core, as is the second winding. An insulating or core jacket is also mounted about the core. The insulating jacket includes a plurality of protrusions or anchors. At least one of the first and second windings is wound about the insulating jacket. The core is a toroid core in one embodiment.

The protrusions include; some anchors placed on the inner diameter of the jacket, and other anchors placed on the outer diameter of the jacket, in embodiment. The anchors are spaced at equal circumferential positions, in an alternative embodiment.

The first winding is a progressive winding, having various sections, and each section has a number of layers, in an alternative embodiment. Each progressive section is anchored by at least two of the anchors.

The first winding is wound directly on the insulating or core jacket in one alternative. The insulating jacket is mounted directly on the core in another alternative.

Two of the protrusions help provide sufficient clearance and creepage in another alternative.

A method of making a transformer that has as a magnetic core and first and second windings includes, according to a second aspect of the invention, the step of winding the first winding about the core. Also, the second winding is wound about the core and an insulating jacket is mounted about the core. The first winding is wound about the insulating jacket. The insulating jacket includes a number of protrusions.

The steps of winding and mounting includes winding and mounting about a toroid core, in one alternative. The step of winding the first winding includes anchoring the first winding with the plurality of protrusions, in another alternative.

The step of winding the first winding includes progressively winding the first winding, in one embodiment. The step of winding the first winding includes the step of winding directly on the insulating jacket, in another embodiment. The insulating jacket is mounted directly on the core in a different embodiment.

Other principal features and advantages of the invention will become apparent to those skilled in the art upon review of the following drawings, the detailed description and the appended claims.

Figure 1:
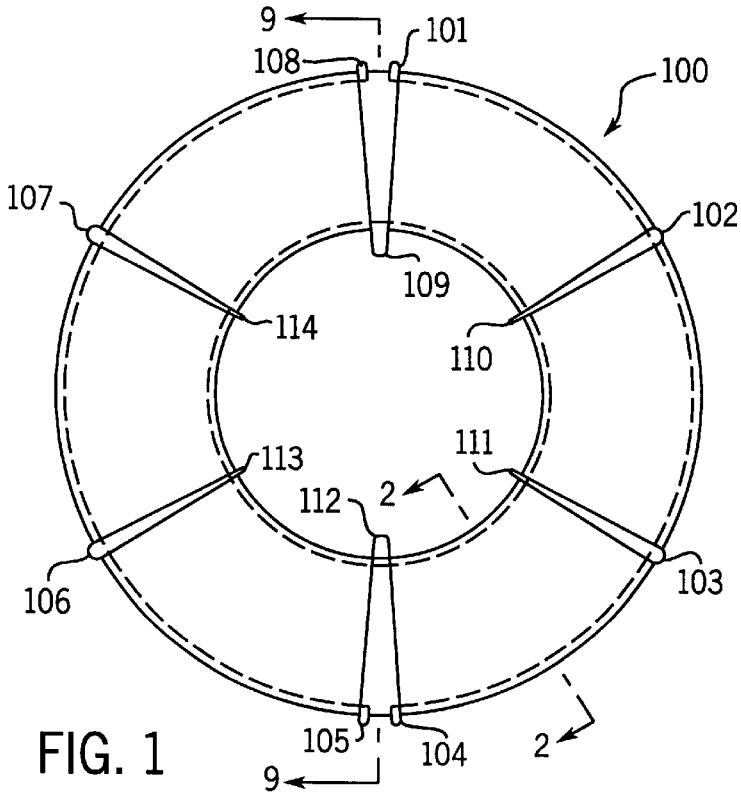
FIG. 1 is a top view of an insulating jacket constructed in accordance with the present invention.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular toroidal core and particular number of windings it should be understood at the outset that the invention can also be employed for other cores (such as "EI," "C" or "D" cores, and other specific winding configurations, as well as cores used in other apparatuses such as inductors, etc.

Generally, the invention includes the use of molded or machined insulating jackets or core jackets which include protrusions to maintain the placement and spacing of windings. Two insulating jackets are placed on a magnetic core (one on each flat surface) and provide electrical insulation for the electrical conductors which are then wound on the insulating jacket. The insulating jacket thus keeps conductors from contacting the core, and electrically shorting. "Jacket," as used herein, may refer to either a single jacket or two jackets placed on the two flat surfaces, or within and between successive layered winding.

The protrusions may be rounded bumps, right angled, or have other geometries. Protrusions as used herein, refer to portions of the insulating jacket that extend beyond the inner or outer diameter, or above the surface of the insulating jacket, and that serve as anchors for at least the first layer of windings (and possibly additional layers of windings), or that provide electrical clearance or reduce electrical creepage. Protrusions may also include something that mechanically connects associated inner and outer protrusions. An anchor, as anchor is used herein, maintains turns of at least one layer of a winding in a proper place.

FIG. 1 shows an insulting jacket 100 constructed in accordance with present invention. Insulating or core jacket 100 has a generally flat, toroidal shape, and is used for insulating conductors of a progressively wound toroid from the transformer core. Insulating jacket 100 includes six inner protrusions 109–114 which, as will be explained below, help maintain proper placement of the windings. Protrusions 109 and 112, which are relatively large, prevent electrical creepage between windings and aid in maintaining electrical clearance between windings. Insulating jacket 100 includes eight outer protrusions 101–108, which, function similarly to the inner protrusions, and help maintain the proper placement. Insulating jacket 100 can be constructed of polyester glass-fiber materials, which are insulating materials and relatively rigid in the preferred embodiment.

Figure 2:
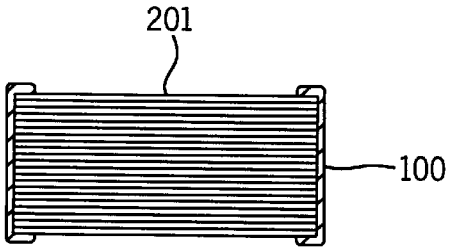
FIG. 2 is a partial cross-sectional view of the insulating jacket of FIG. 1 placed on a magnetic toroidal core.

The method of using the inventive insulating or core jacket can be seen by referring to FIGS. 4–9, which show the winding of the transformer at various stages. Insulating jacket 100 is used to insulate the first layer of a winding from a magnetic core 201 (FIG. 2). Core 201 may be a wound steel lamination, ferrites, or other typical torriodal core construction. FIG. 2 is a partial cross sectional view of two insulating jackets 100 mounted on core 201.

Alternatively, insulating jacket 100 may also be used to insulate successive windings by placing two of insulating jackets 100 over the flat surface of a completed winding. Then, an additional winding is placed over insulating jacket 100. The thickness of insulating jacket 100 should provide sufficient physical distance between the windings to meet creepage and clearance standards.

Figure 3:
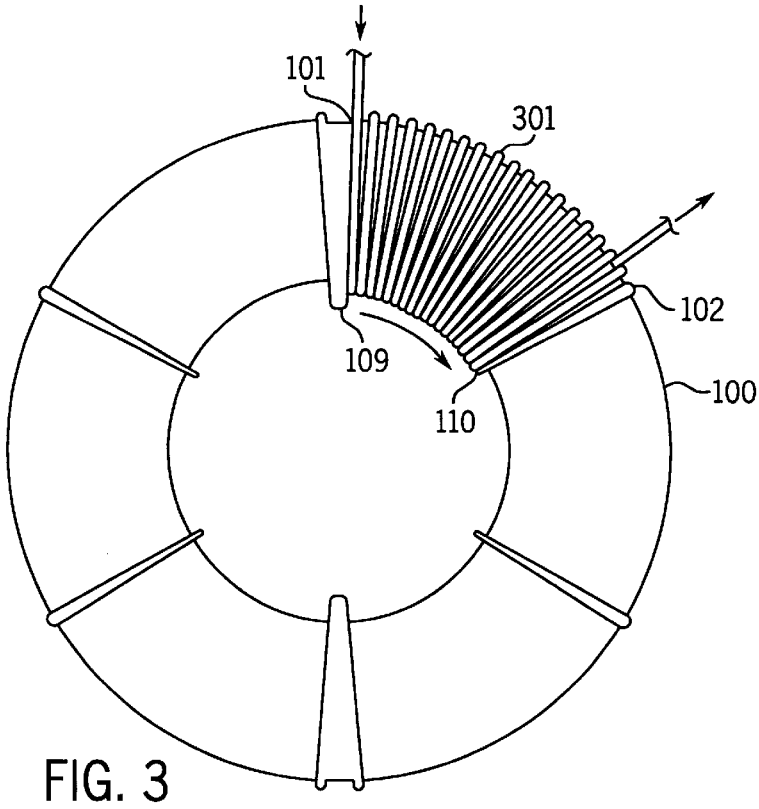
FIG. 3 is a top view of the insulating jacket of FIG. 2 with one layer of windings wound thereon.

FIG. 3 shows insulating jacket 100, and a first conductor layer 301 of a first progressive section wound about insulating jacket 100 (and core 201). First layer 301 is wound in a conventional manner in that all turns are placed immediately adjacent to one another (in contact with each other). An item is wound or placed about a core, as wound and about are used herein, if the item is over the core. Other things may be between the core and item, and about is still used to describe the positions. For example, as described above, layer 301 is wound about core 201 even though insulating jacket 100 is between core 201 and layer 301. An item is wound or placed directly on a core or other thing when nothing is disposed therebetween.

Each section of the progressive winding has a protrusion that marks the beginning and end of that progressive section. The protrusions maintain or anchor the windings in the proper position. First layer 301 is shown wound between protrusions 109 and 110 on the inner edge, and between protrusions 101 and 102 on the outer edge. The windings of layer 301 are held in place between inner protrusions 109 and 110, as shown in FIG. 3.

Figure 4:
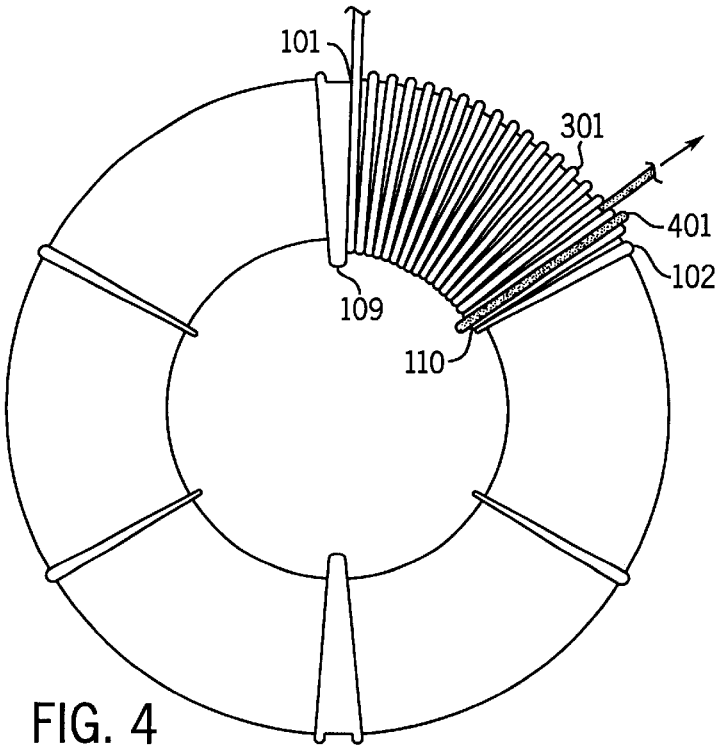
FIG. 4 is a top view of the first turn in a second layer wound on the first layer, insulating jacket, and core of FIG. 3.

A first turn 401 (shown in black) of the second layer of the first progressive section is shown in FIG. 4. It may be seen that first turn 401 is disposed or placed between the last two turns on first layer 301 on the inner diameter due to space constraints. Preferably, first turn 401 will nestle between the last two turns of the first layer, however in practice first turn 401 may cross over turns of the first layer on the outer diameter. When first turn 401 is placed on layer 301, it must be done so with sufficient force to bend it and form a snug fit. Often, in the prior art, first turn 401 would pull down to the insulation surface and force the last turn of layer 301 into the adjacent (next) progressive winding section. Protrusions 110 and 102 prevent that from happening in accordance with the present invention. It may be seen that, in the preferred embodiment, the outer protrusions anchor the second (and subsequent) layers of conductors. Other layers will be anchored by the outer protrusions in other embodiments.

Figure 5:
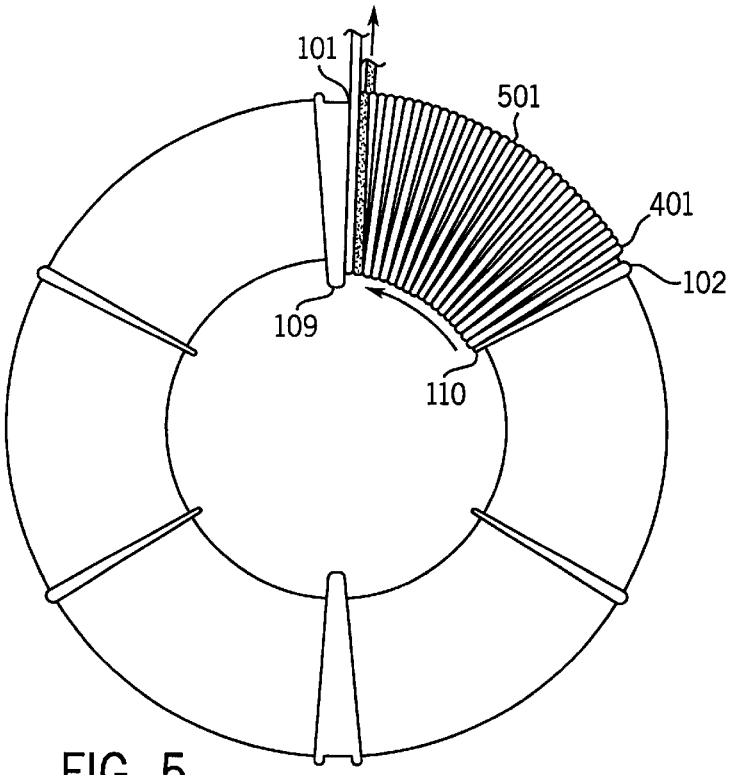
FIG. 5 is a completed second layer of a winding wound on the first layer, insulating jacket, and core of FIG. 3.

FIG. 5 shows the completion of a second layer 501 of the first section of the progressive winding. Protrusions 109 and 101 maintain a proper position and prevent spreading of the end turns of first layer 301 into the adjacent (previous) progressive winding section.

Figure 6:
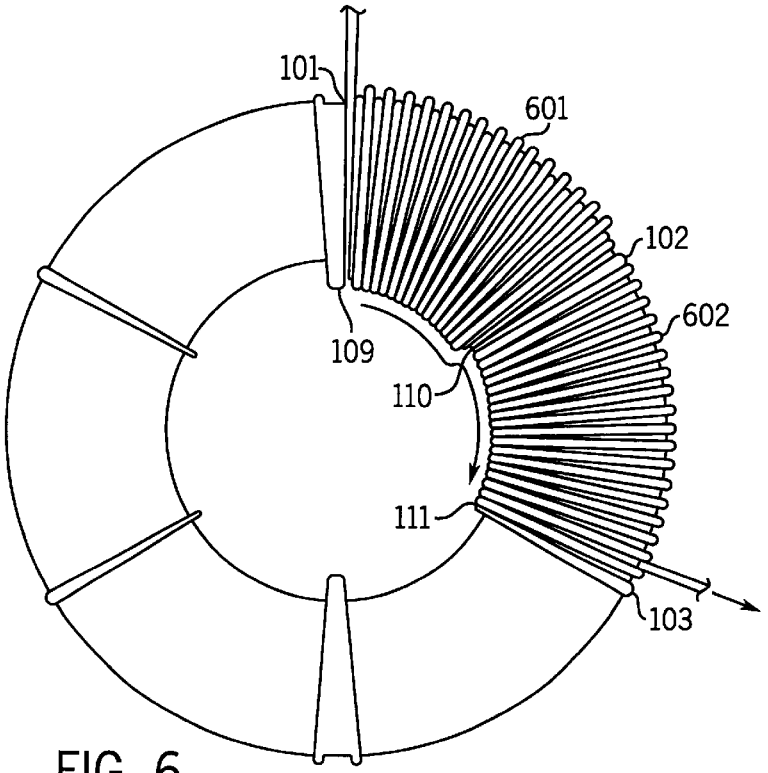
FIG. 6 is a top view of a progressively wound core with the first progressive section completed and a first layer of the second progressive section completed.

FIG. 6 shows a completed first progressive section winding with a third layer 601 disposed over layers 301 and 501, and between protrusions 109–110 and 101–102. Layer 602 of a second progressive section is wound after layer 601, and extends between protrusions 110 and 111 on the inner diameter and between protrusions 102 and 103 on the outer diameter. Protrusions 110, 111, 102, and 103 function for the second progressive sections as protrusions 109, 110, 101 and 102 did for the first progressive section.

Figure 7:
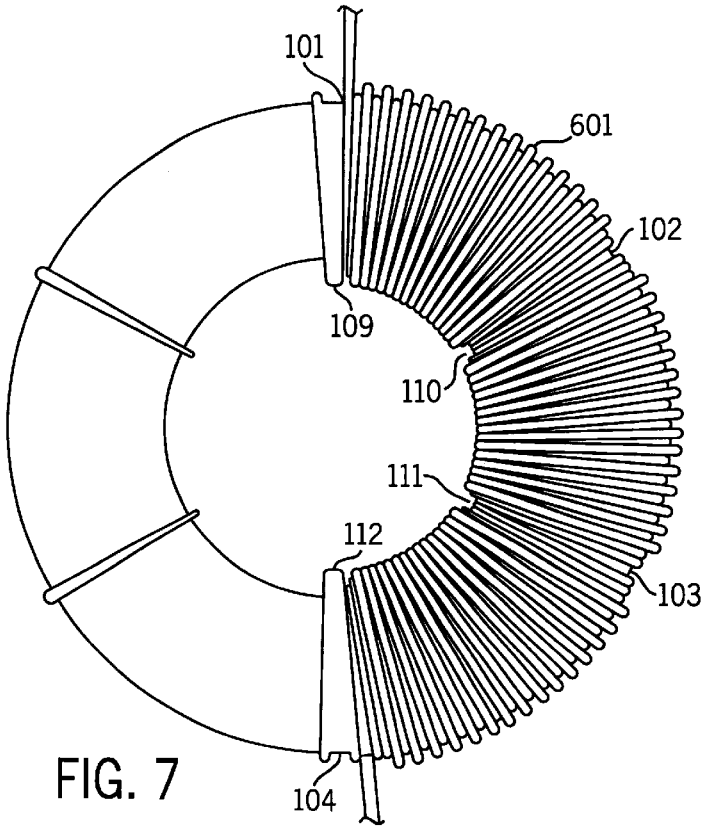
FIG. 7 is a top view of a complete winding having three progressively wound sections, each with three layers, on the insulating jacket and core.

FIG. 7 shows a completed winding comprised of three progressive winding sections. Each of the progressive winding sections include three conductor layers. Again, protrusions are used to anchor each progressive winding section.

Figure 8:
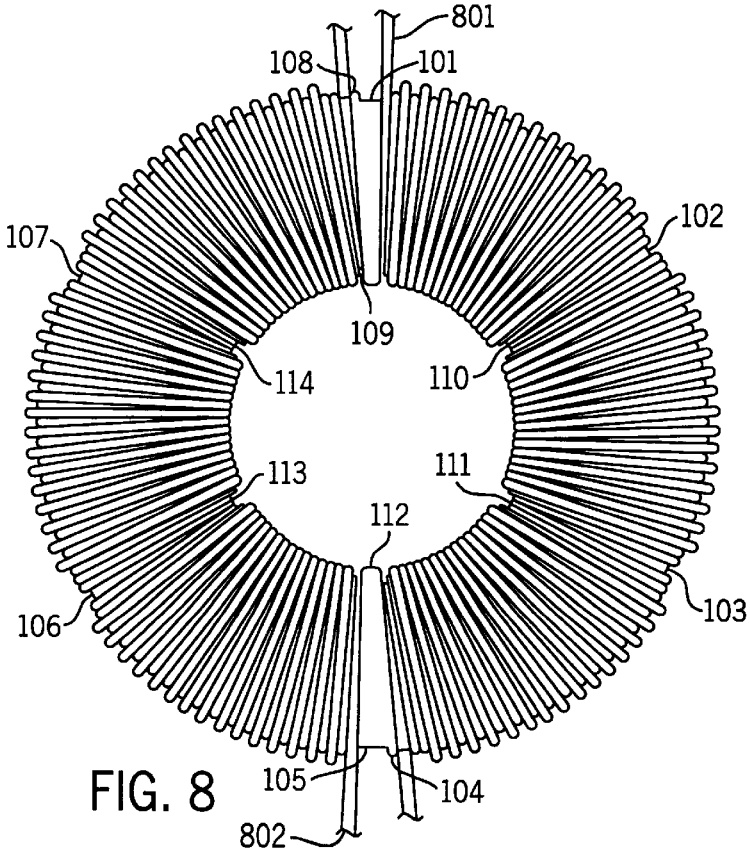
FIG. 8 is a complete progressively wound transformer, having two complete windings wound in accordance with the present invention.

FIG. 8 shows the completed, progressively wound, transformer. There are two complete windings 801 and 802, each having a beginning and ending lead, with a total of six progressive winding sections each anchored in place by protrusions. Each section includes three layers of windings. Electrical clearance and creepage standards require that there be a sufficient distance between windings 801 and 802.

Figure 9:
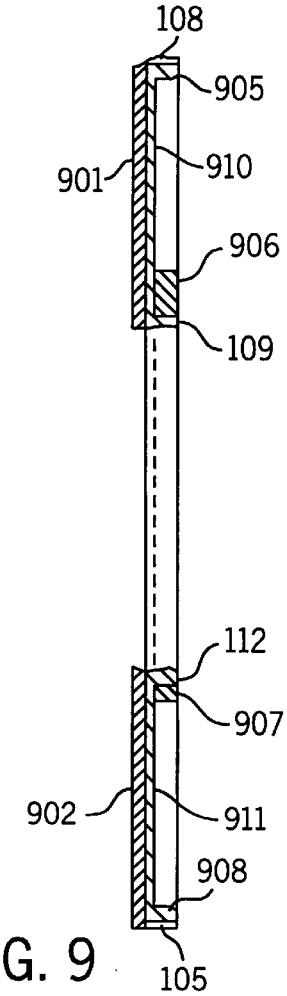
FIG. 9 is a cross sectional view of the insulating jacket of FIG. 1 taken along lines 9—9.

Protrusions 109 and 112, which separate winding 801 and 802, are larger than protrusions 110, 111, 113, and 114 to help provide the distance sufficient for electrical clearance and to prevent electrical creepage between windings. FIG. 9 shows a cross sectional view of inner protrusions 109, 112, 108, and 105. Protrusions 109 and 112 extends farther into the center "hole" than do protrusions 110, 111, 113 and 114, as well as have a greater width. Protrusion 109 is connected by a ridge 901 to protrusions 101 and 108. Similarly, protrusion 112 is connected by a ridge 902 to protrusions 104 and 105. (The other protrusions are connected by similar, but smaller ridges (FIG. 1). The width and height of ridges 901 and 902 aid in providing electrical clearance and preventing electrical creepage. Thus, it may be seen that protrusions 109 and 112 help to position windings, as well as provide electrical clearance and prevent electrical creepage.

As may be seen the method and apparatus of this invention allows for progressive winding sections in a way in which spreading is prevented. This allows for increased density of windings, and allows for smaller, lighter, and cheaper transformers for given electrical characteristics.

Numerous modifications, including using protrusions that provide less than all of the positioning, creepage and clearance features, may be made to the present invention which still fall within the intended scope hereof. Thus, it should be apparent that there has been provided in accordance with the present invention a method and apparatus for winding toroidal transformers that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An apparatus comprising:

a magnetic core having at least one flat surface;

a first winding wound about the core;

a second winding wound about the core; and at least one generally flat, toroidal, insulating jacket mounted over the flat surface of the core, wherein the insulating jacket includes an inner and an outer diameter, a plurality of protrusions having a greater width near the outer diameter than the inner diameter, and further wherein at least one of the first and second windings has a plurality of layers and is progressively wound about the insulating jacket, wherein the protrusions protrude from the flat surface a sufficient distance to anchor the plurality of layers.

2. The apparatus of claim 1 wherein the core is a toroid core.

3. The apparatus of claim 2 wherein the plurality of protrusions includes a first group of protrusions on an inner diameter of the insulating jacket.

4. The apparatus of claim 3 wherein the plurality of protrusions includes a second group of protrusions on an outer diameter of the insulating jacket.

5. The apparatus of claim 4 wherein the plurality of protrusions are spaced at equal circumferential positions.

6. The apparatus of claim 3 wherein the first winding is a progressive winding comprising a plurality of sections, and wherein each section includes a plurality of layers.

7. The apparatus of claim 6 wherein each progressive section is anchored by at least two of the plurality of protrusions.

8. The apparatus of claim 1 wherein the first winding is wound directly on the insulating jacket.

9. The apparatus of claim 8 wherein the second winding is wound directly on the insulating jacket.

10. The transformer of claim 9 wherein the insulating jacket is mounted directly on the core.

11. The apparatus of claim 9 wherein at least two of the protrusions are disposed and have sufficient size to provide electrical clearance between the first and second windings.

12. The apparatus of claim 11 wherein the at least two of the protrusions are disposed and have sufficient size to reduce electrical creepage.

13. The apparatus of claim 12 wherein the core is a toroid and the first winding is wound on a first segment of the core and the second winding is wound on second segment of the core.

14. A transformer comprising:

a magnetic core having at least one flat surface;

a first winding wound about the core;

a second winding wound about the core; and an insulating jacket means, generally flat and toroidal and having an inner and an outer diameter, for anchoring multiple layers of at least one of the first and second windings, mounted about the core, wherein the insulating jacket means includes a plurality of protrusions having a greater width near the outer diameter than the inner diameter, and further wherein the at least one of the first and second windings has a plurality of layers and is progressively wound about the insulating jacket means, wherein the plurality of protrusions protrude from the flat surface a sufficient distance to anchor the plurality of layers.

15. The transformer of claim 14 wherein the core is a toroid core.

16. The transformer of claim 15 wherein the plurality of protrusions includes a first group of protrusions on an inner diameter of the insulating jacket means.

17. The transformer of claim 16 wherein the plurality of protrusions includes a second group of protrusions on an outer diameter of the insulating jacket means.

18. The transformer of claim 15 wherein the first winding is a progressive winding comprising a plurality of sections, and wherein each section includes a plurality of layers.

19. The transformer of claim 18 wherein each progressive section is anchored by protrusions.

20. The transformer of claim 14 wherein the first winding is wound directly on the insulating jacket means.

21. The transformer of claim 20 wherein the second winding is wound directly on the insulating jacket.

22. The transformer of claim 21 wherein the insulating jacket means is mounted directly on the core.

23. The transformer of claim 21 wherein at least two of the protrusions are disposed and have sufficient size to provide electrical clearance between the first and second windings.

24. The transformer of claim 23 wherein the at least two of the protrusions are disposed and have sufficient size to reduce electrical creepage.

25. The transformer of claim 24 wherein the core is a toroid and the first winding is wound on a first segment of the core and the second winding is wound on second segment of the core.

* * * * *